United States Patent [19]

Yuhara

[11] 4,366,829

[45] Jan. 4, 1983

[54] VANITY CASE

[75] Inventor: Yukitomo Yuhara, Abikio, Japan

[73] Assignee: Yoshida Industry Co., Ltd., Tokyo, Japan

[21] Appl. No.: 300,282

[22] Filed: Sep. 8, 1981

[30] Foreign Application Priority Data

Mar. 16, 1981 [JP] Japan ..... 56-35388[U]

[51] Int. Cl.[3] ..... A45D 33/00

[52] U.S. Cl. ..... 132/83 R

[58] Field of Search ..... 132/83 R

[56] References Cited

U.S. PATENT DOCUMENTS 1,501,130 7/1924 Morrison ..... 132/83 R 2,035,831 3/1936 Parkin ..... 132/83 R 4,276,893 7/1981 Enomoto ..... 132/83 R

*Primary Examiner*—G. E. McNeill

*Attorney, Agent, or Firm*—Wenderoth, Lind & Ponack

[57] ABSTRACT

A vanity case is provided which comprises a receptacle and a cover members, a cavity formed in one of the members and a slider element slidably inserted at its inner portion into the cavity. The slider element has an enlarged outer portion and is so arranged that when the slider element is pushed inwardly, the enlarged outer portion exerts such a force as to release a snap engagement of the cover member with the receptacle member. An elastic piece formed integrally with the slider element urges the latter outwardly along the cavity.

5 Claims, 10 Drawing Figures

VANITY CASE

BACKGROUND OF THE INVENTION

This invention relates to an improvement of a vanity case having a receptacle member and a cover member hinged with each other and arranged to be latched by snap engagement of a pair of elastic latch tongues.

In a known vanity case, such as a compact case, of the type set forth above, the latch tongues are integrally formed with the receptacle and cover members, respectively, by plastic molding. These elastic latch tongues have to be formed very precisely in dimensions. Because, if the engagement between both latch tongues is loose, the cover member of the vanity case will open accidentally. On the contrary, if the latch tongues are very fast engaged with each other, a relatively strong force will be required to open the cover member, thereby causing a trouble to a user. Accordingly, when the cover and receptacle members are formed by the molding, the utmost attention has been paid to the accuracy of the dimensions of the latch tongues. However, inferior vanity cases having defective dimensions in the latch tongues have been experienced inevitably at a relatively high percentage.

As an improvement of the defects set forth above, the present applicant has proposed to provide a slider element which releases the snap engagement between both latch tongues when it is pushed in the horizontal direction. This structure has remarkable advantages that the engagement as mentioned above can be released very easily with a small pushing force thereby making it possible to firmly engage the latch tongue with the other one without necessity of high dimensional accuracy as required in the conventional vanity case. However, since the slider element in the above proposed vanity case is loosely fitted in a cavity formed in the receptacle member or cover member, the slider element becomes shaky in the cavity after disengaging the cover member from the receptacle member. Such a shaky movement of the slider element deteriorates a high-grade image of the vanity case.

Accordingly, an object of the present invention is to provide an improved vanity case which can open a cover member very easily by a slider element and which can ensure a prevention of a shaky movement of the slider element in a cavity formed in a receptacle member or a cover member.

Another object of the present invention is to provide a vanity case of the type set forth above which can be assembled without any additional process to the above proposed case and which has a high-reliability in operation.

SUMMARY OF THE INVENTION

A vanity case according to the present invention comprises a receptacle member for containing cosmetic material therein, a cover member hinged with the receptacle member at the rear end thereof with the receptacle member, a cavity formed in either the receptacle member or the cover member and extending therein from a front end thereof, and a slider element made from synthetic resin having elasticity and slidably inserted at an inner portion thereof into the cavity. Provided are a first latching member in the receptacle or cover member where the cavity is formed and a second latching member in the other, the second latching member being adapted to be engaged with the first latching member when the receptacle member is closed by the cover member. The slider element has an enlarged outer portion which is arranged to locate closely adjacent to a front end of the other member where the second latching member is provided in such a manner that when the slider element is pushed inwardly, the enlarged outer portion thereof exerts such a force as to disengage the first latching member from the second one.

The slider element also has an elastic piece made from the synthetic resin and formed integrally therewith. An outer end of the elastic piece is connected with the slider element while an inner end of the elastic piece is pressed against an inner wall defining the cavity, thereby the slider element being always urged outwardly along the cavity.

Further objects and features of the present invention will become apparent from the detailed description of preferred embodiments thereof when taken in conjunction with the accompanying drawings, in which:

DETAILED DESCRIPTION OF THE INVENTION

Figure 1:
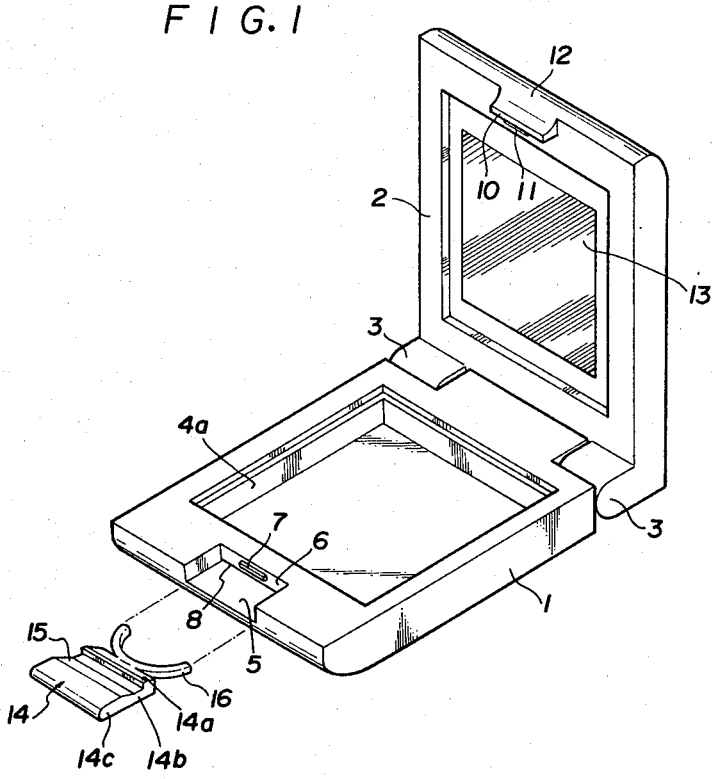
FIG. 1 is a perspective view showing a vanity case according to a first embodiment of the present invention before complete assembly thereof.
Figure 2:
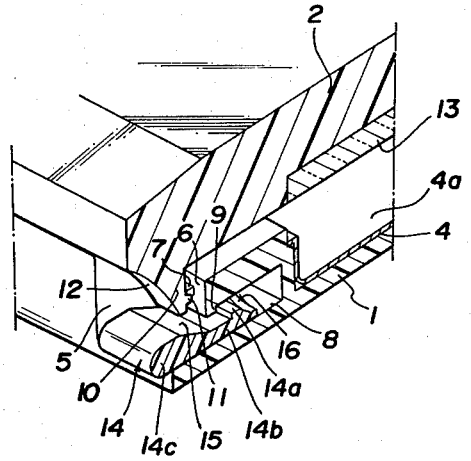
FIG. 2 is a partially sectioned perspective view of a part of the same vanity case as shown in FIG. 1 but after the complete assembly thereof.

Referring now to FIGS. 1 to 4 of the drawings, there is shown a vanity case, i.e. compact case, according to a first embodiment of the present invention. The vanity case is made from plastic and mainly comprises a receptacle member 1 and a cover member 2 connected with each other by a hinge 3 along each rear end of both members.

The receptacle member 1 is provided with a concaved portion 4 in which a tray 4*a* is fitted for containing cosmetic material therein. An upper front end between the concaved portion 4 and an upper front edge of the receptacle member 1 is cut out rectangularly at the center part thereof to form a recess 5. A first latch tongue 7 having elasticity is provided and integrally formed on an end wall 6 which partly defines the recess 5. The lower part of the recess 5 deeply extends toward the concaved portion 4 of the receptacle member 1 thereby forming a cavity 8. As clearly shown in FIGS. 2 to 4, the lower surface defining the cavity 8 has a flat surface while the upper surface thereof has a protrusion 9 at a front end.

The cover member 2 is integrally provided with a rectangular projection 10 vertically extending downwardly from a front end of the cover member. This projection 10 has a second elastic latch tongue 11 formed on an inner vertical surface thereof and also containes an inclined outer surface 12. As shown in the drawings, the projection 10 can enter into the recess 5 of the receptacle member 1 in case the cover member is partially closed, and the second latch tongue 11 can be engaged with the first tongue 7 in the recess by snap action to completely close the receptacle member by the cover.

A mirror 13 may be fitted to the inner surface of the cover member 2.

Figure 3:
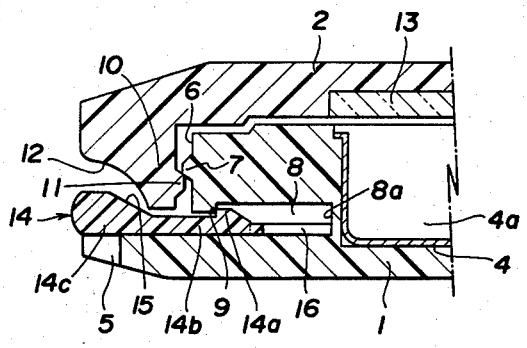
FIG. 3 is an enlarged sectional view of the same part of the vanity case in a latched position

A slider element 14 made from plastic is slidably inserted into the recess 5 of the receptacle member 1 and the cavity 8 formed at the lower part of the recess. The slider element 14 containes an inner hook portion 14*a* and an intermidiate flat portion 14*b*, both of which are capable of being inserted into the cavity 8, and an outer enlarged head 14*c* slidaby movable in the recess 5. Between the flat portion 14*b* and the enlarged head 14*c* is formed an upper slant surface 15 which will locate closely adjacent to the lower end of the projection 10 of the cover member 2 when the latter is closed upon the receptacle member 1, as shown in FIG. 3.

A thickness of the hook portion 14*a* is such that it can be forcedly into the cavity 8 due to the elasticity thereof but once it is inserted in the cavity, the hook portion becomes to be engagable with the protrusion 9 in the cavity 8 thereby preventing the slider element from slipping out of the cavity. Also, the intermediate flat portion 14*b* has a thickness slightly smaller than the gap formed between the protrusion 9 and the lower surface of the cavity and the enlarged head 14*c* has a thickness much more than the gap.

Further, the slider element is provided at the inner end thereof with an elastic piece 16 which is made from plastic and formed integrally with the slider element 14. In this embodiment, the elastic piece 16 is formed in the semi-circular shape with an outer or a top end portion thereof being integrally connected to the inner end of the slider element. The elastic piece 16 is pressed against an inner wall 8*a* defining the cavity 8 when the slider is inserted into the cavity. Therefore, after the insertion the slider element 14 is urged outwardly or forwardly by an elastic force caused in the elastic piece 16.

Figure 4:
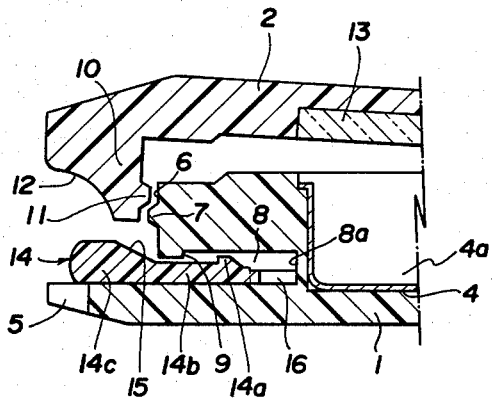
FIG. 4 is an enlarged sectional view of the same part of the vanity case in an unlatched position.

Now, the usage of the present compact case is described. In the position as shown in FIG. 3, the cover member 2 is closed over the receptacle member 1 where the first latch tongue 7 of the receptacle member is engaged with the second tongue 11 of the cover member and the hook portion 14*a* of the slider element 14 is engaged by the force of the elastic piece 16 with the protrusion 9 formed at the upper surface of the cavity 8. From this position, when the enlarged head 14*c* of the slider element is pushed inwardly by any convenient way, for example, by a finger of a user, the slider moves inwardly against the force of the elastic piece 16 which, in turn, is further compressed. At this time, since the upper slant surface 15 in the slider element 14 acts against the lower end of the projection 10 of the cover member to lift the cover, the engagement of the first resillient latch tongue 7 with the second one 11 is released and the cover member 2 is partially opened from the receptacle member 1 as shown in FIG. 4, thereby making it possible to freely open the cover to any desired angle for using the mirror 13 as well as the cosmetic material in the tray 4*a*.

Once the engagement between both tongues 7 and 11 is released, such engagement will not be effected until the cover member 2 is pressed down by the user. However, the slider element 14 is returned to the original position by the force of the elastic piece 16 integrally formed therewith the moment the pushing force applied to the slider element is removed, where the hook portion 14*a* becomes to be engaged with the protrusion 9.

As it could be understood from the description of the first embodiment of the present invention, since the elastic piece 16 integrally formed with the slider element 14 urges the latter outwardly along the cavity 8, no shaky movement of the slider does not occur in the cavity even after the cover member 2 is opened from the receptacle member 1. Furthermore, the elastic force caused in the elastic piece 16 can be obtained and applied to the slider element 14 without fail because the elastic piece 16 is formed and connected integrally with the slider 14 at the inner end thereof. Such a structure of the elastic piece 16 and the slider element 14 has a further advantage that it makes it possible to reduce the number of the parts and to facilitate the assembly of the vanity case.

Figure 5:
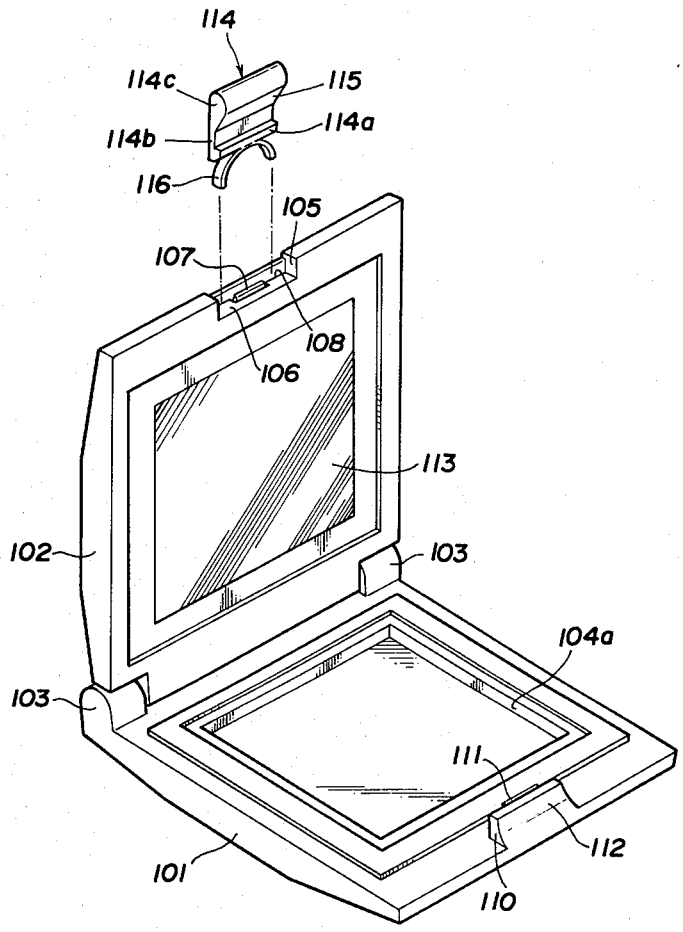
FIG. 5 is a perspective view of a vanity case according to a second embodiment of the present invention before complete assembly thereof.
Figure 6:
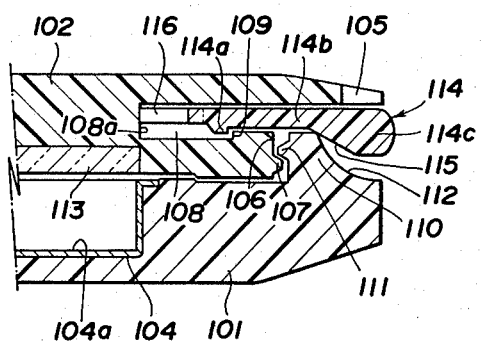
FIG. 6 is an enlarged sectional view showing a part of the vanity case of the second embodiment in a latched position after the complete assembly.
Figure 7:
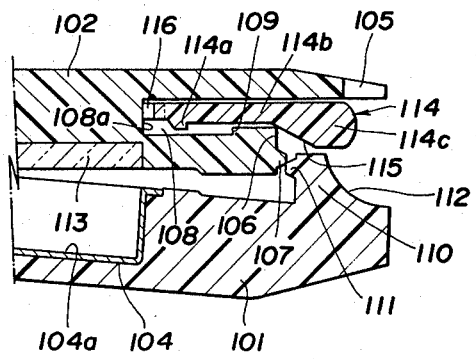
FIG. 7 is an enlarged sectional view showing the same part of the vanity case of the second embodiment in an unlatched position.
Figure 8:
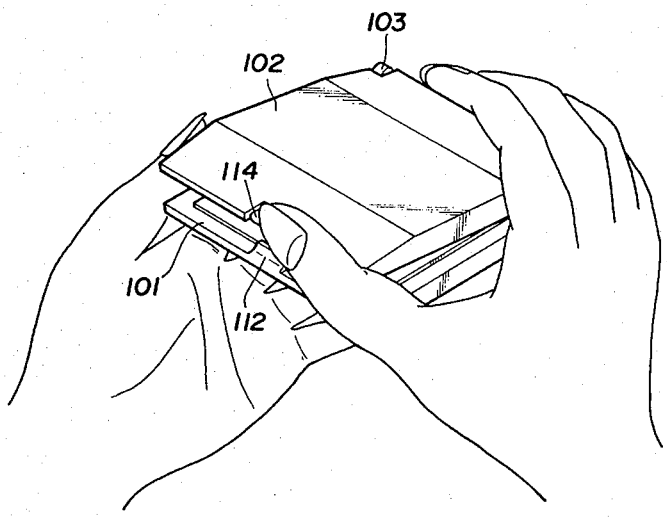
FIG. 8 is a perspective view showing the manner of use of the vanity case according to the second embodiment of the present invention.

Reference is now made to a second embodiment of the present invention shown in FIGS. 5 to 7, wherein the same reference numerals will be adopted to the parallel or similar parts as those of the first embodiment but with addition of "100". In this embodiment, a slider element 114 integrally formed with an elastic piece 116 is slidably inserted into a cavity 108 formed at the upper part of a recess 105 which is provided in a cover member 102. On the other hand, a projection 110 having a second elastic latch tongue 111 is formed at a front end of a receptacle member 101 and vertically extends upwardly therefrom. Other structures of the compact case of the second embodiment and the operations thereof are substantially the same as those of the first embodiment. However, since the compact case is usually used with it being placed on the palm of the user's hand as shown in FIG. 8, the user can open the cover member 102 by a thumb which pushed the slider element 114 inwardly, without changing the holding position of the case.

Figure 9:
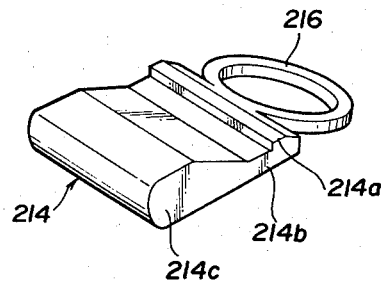
FIG. 9 is an enlarged perspective view showing an elastic piece of a vanity case according to another embodiment of the present invention.
Figure 10:
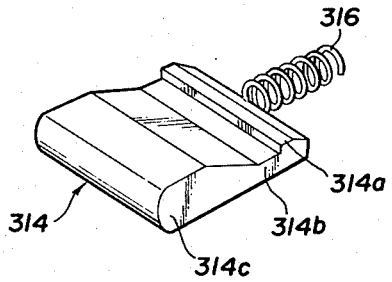
FIG. 10 is an enlarged perspective view showing an elastic piece of a vanity case according to further embodiment of the present invention.

FIGS. 9 and 10 respectively show modified structures of the elastic piece integrally formed with the slider element. As shown in these figures, the elastic piece may be a plastic ring 216 being integrally connected at its outer or front end with an inner end of a slider element 214 or may be a coil spring 316 made of plastic integrally with a slider element 314. The structures of the slider elements 214 and 314, and the functions of these elastic pieces 216 and 316 are the same as those in the first embodiment.

Although the present invention has been described with reference to preferred embodiments thereof, many modifications and alterations may be made within the spirit of the present invention.

What is claimed is:

1. A vanity case comprising a receptacle member for containing cosmetic material therein, a cover member hinged at the rear end thereof with said receptacle member, a cavity formed in either said receptacle member or said cover member and extending therein from a front end thereof, a slider element made from synthetic resin having elasticity and slidably inserted at an inner portion thereof into said cavity and an outer portion of said slider element being enlarged, a first latching member provided in said receptacle or cover member where said cavity is formed, a second latching member provided in the other of said receptacle or cover member and adapted to be engaged with said first latching member when said receptacle member is closed by said cover member, said enlarged outer portion of said slider element being arranged to locate closely adjacent to a front end of said other member where said second latching member is provided in such a manner that when said slider element is pushed inwardly, said enlarged outer portion thereof exerts such a force as to disengage said first latching member from said second member, wherein said slider element has an elastic piece made from the synthetic resin and formed integrally therewith, an outer end of said elastic piece being connected with said slider element while an inner end of said elastic piece is pressed against an inner wall defining said cavity thereby said slider element being always urged outwardly along said cavity.

2. A vanity case as claimed in claim 1, wherein said elastic piece formed integrally with said slider element has a configuration substantially of a semicircle, an outer or a top end thereof being connected to an inner end of said slider element.

3. A vanity case as claimed in claim 1, wherein said elastic piece is substantially in the shape of a ring integrally formed and connected at its outer end with said slider element.

4. A vanity case as claimed in any one of the preceding claims, wherein said inner portion of said slider element and said elastic piece are provided in said cavity formed in said receptacle member.

5. A vanity case as claimed in claim 1, 2 or 3, wherein said inner portion of said slider element and said elastic piece are provided in said cavity formed in said cover member.

* * * * *